US006163886A

United States Patent [19]

Carter

[11] Patent Number: 6,163,886

[45] Date of Patent: Dec. 26, 2000

[54] REMOVABLE WEATHER GUARD FOR HEADWEAR

[76] Inventor: Russell J. Carter, 2713 N. Wright St., Santa Ana, Calif. 92705

[21] Appl. No.: 09/246,205

[22] Filed: Feb. 8, 1999

[51] Int. Cl.[7] ..... A42B 1/06

[52] U.S. Cl. ..... 2/172; 2/181.4; 2/209.13

[58] Field of Search ..... 2/172, 209.13, 2/175.6, 422, 918, 181.4

[56] References Cited

U.S. PATENT DOCUMENTS

| | | | |
|---|---|---|---|
| 889,640 | 6/1908 | Sherman | 2/172 |
| 2,055,560 | 9/1936 | Rose | 2/172 |
| 5,046,195 | 9/1991 | Koritan . | |
| 5,081,717 | 1/1992 | Shedd et al. . | |
| 5,121,507 | 6/1992 | Brown . | |
| 5,153,943 | 10/1992 | Clement . | |
| 5,161,259 | 11/1992 | Shorts . | |
| 5,201,077 | 4/1993 | Donlinger | 2/199 |
| 5,212,837 | 5/1993 | Gose et al. . | |
| 5,355,535 | 10/1994 | Bruder . | |
| 5,448,778 | 9/1995 | Phillips . | |
| 5,493,734 | 2/1996 | Nieves-Rivera | 2/209.13 |
| 5,655,225 | 8/1997 | Mathers . | |
| 5,669,074 | 9/1997 | Newman, Jr. . | |

*Primary Examiner*—John J. Calvert
*Assistant Examiner*—Katherine Moran
*Attorney, Agent, or Firm*—Knobbe, Martens, Olson & Bear, LLP

[57] ABSTRACT

A removable weather guard or sunshade enables easy attachment and repositioning relative to a cap. The weather guard hangs from an upper edge of an inner band common to most caps. Specifically, the weather guard has staying tabs with downwardly depending elements. The staying tabs are affixed to an upper portion of a flexible shield at an attachment location. The attachment location rests on the upper edge of the inner band while the downwardly depending elements are interposed between the headband and the cap's crown and the shield is disposed between the headband and the head of a wearer.

19 Claims, 3 Drawing Sheets

REMOVABLE WEATHER GUARD FOR HEADWEAR

BACKGROUND OF THE INVENTION

1. Field of the Invention

The present invention generally relates to a weather guard for use with headwear, more particularly to a removable weather guard having a simplified staying tab arrangement.

2. Description of the Related Art

In recent years, extensive media coverage has been devoted to the adverse effects on skin related to prolonged exposure to the sun. While caps, such as baseball caps having forward facing bills, may reduce the degree of direct sunlight contacting the face, such caps are limited in the protection which they afford to neck and shoulder regions. Accordingly, several attempts have been made to provide such caps with sunshades and weather guards, which also reduce the amount of precipitation that rims off the back of the hat and down the neck.

Such sunshades and weather guards have been manufactured as integral members of the cap (i.e., the headwear associated with the French Foreign Legion) and as a removable element that may be attached to the cap when desired and removed when unnecessary or undesired. The removable sunshades and weather guards have been provided in a variety of configurations. For instance, when stripped to its essence, a handkerchief or bandana is placed over the head and allowed to drape over the neck of the wearer. The handkerchief or bandana is then held in position by a hat that is placed on the head of the wearer over the handkerchief or bandana. Over time, the handkerchief or bandana may bunch or work free from the hat and, therefore, will require frequent adjustment or repositioning.

Another simplified configuration involves tucking the handkerchief or bandana into an upturned sweatband portion of the cap. Again, this configuration often results in uncomfortable bunching of the handkerchief or bandana, particularly within the headband of the cap. Moreover, the tucked material of the handkerchief or bandana, due to its flexible nature, will easily slide from its tucked position in the headband and, therefore, will also require frequent adjustment or repositioning.

Because the simplified configurations did not provide an adequate solution, many more elaborate configurations were developed. For instance, hook and loop (i.e., Velcro®) fasteners were positioned either inside the cap band or outside on the cap's exterior. The corresponding fastener was positioned on the sunshade or weather guard to enable the sunshade or weather guard to be attached to the cap. The inside arrangement led to discomfort due to the increased thickness caused by the hook and loop fastener while the outside arrangement detracted from the appearance of the cap when the sunshade or weather guard was unattached. Additionally, the outside arrangement proved ineffective for weather guard applications as the gap allowed rain and the like to run between the cap and the weather guard.

Other similar configurations have also resulted in unsightly clips or fasteners which were exposed on the exterior of the cap either when the sunshade or weather guard was affixed to the cap or when the sunshade or weather guard was removed from the cap. Additionally, substantially rigid structures that were suggested typically caused discomfort for the wearer during extended periods of use. Moreover, complicated fastening arrangements often increased manufacturing costs and drove the final product cost beyond the range commercially acceptable to the purchasing public.

SUMMARY OF THE INVENTION

Accordingly, there is a need for a simple yet effective system for attaching sunshades or weather guards to headwear such that the system is substantially concealed from sight. There is a further need for a system that is easily manufactured and easily employed by the consumer. Moreover, there is a need for a system that is configured to enhance the comfort of the consumer during the extended periods of use commonly associated with sunshades and weather guards.

Thus, in accordance with the present invention, a system is disclosed which features at least one, preferably two, and potentially more downward depending tabs. The tabs are manufactured from a thin and pliable, yet sufficiently rigid, material and are attached at an upper portion of a weather guard shield. Preferably, the tabs are sewn adjacent to a hem in the shield material and each tab consists of a downwardly depending member. The tabs are arranged on the upper portion of the weather guard shield in positions such that the tabs may lie to either side of the consumer's head while the sunshade or weather guard is attached to the cap. To attach the sunshade or weather guard to the cap, the tabs are inserted into a pocket defined between an upwardly tuned headband and an inner surface of the cap's exterior. The tabs may be slid within this pocket to allow the positioning and drape of the sunshade or weather guard to be adjusted as desired by the consumer. Moreover, the tabs are advantageously concealed from sight in this arrangement.

BRIEF DESCRIPTION OF THE DRAWINGS

These and other features, aspects and advantages of the present invention will now be described with reference to the following drawings of a preferred embodiment that is intended to illustrate and not to limit the invention, and in which.

DETAILED DESCRIPTION OF THE PREFERRED EMBODIMENT

Figure 1:
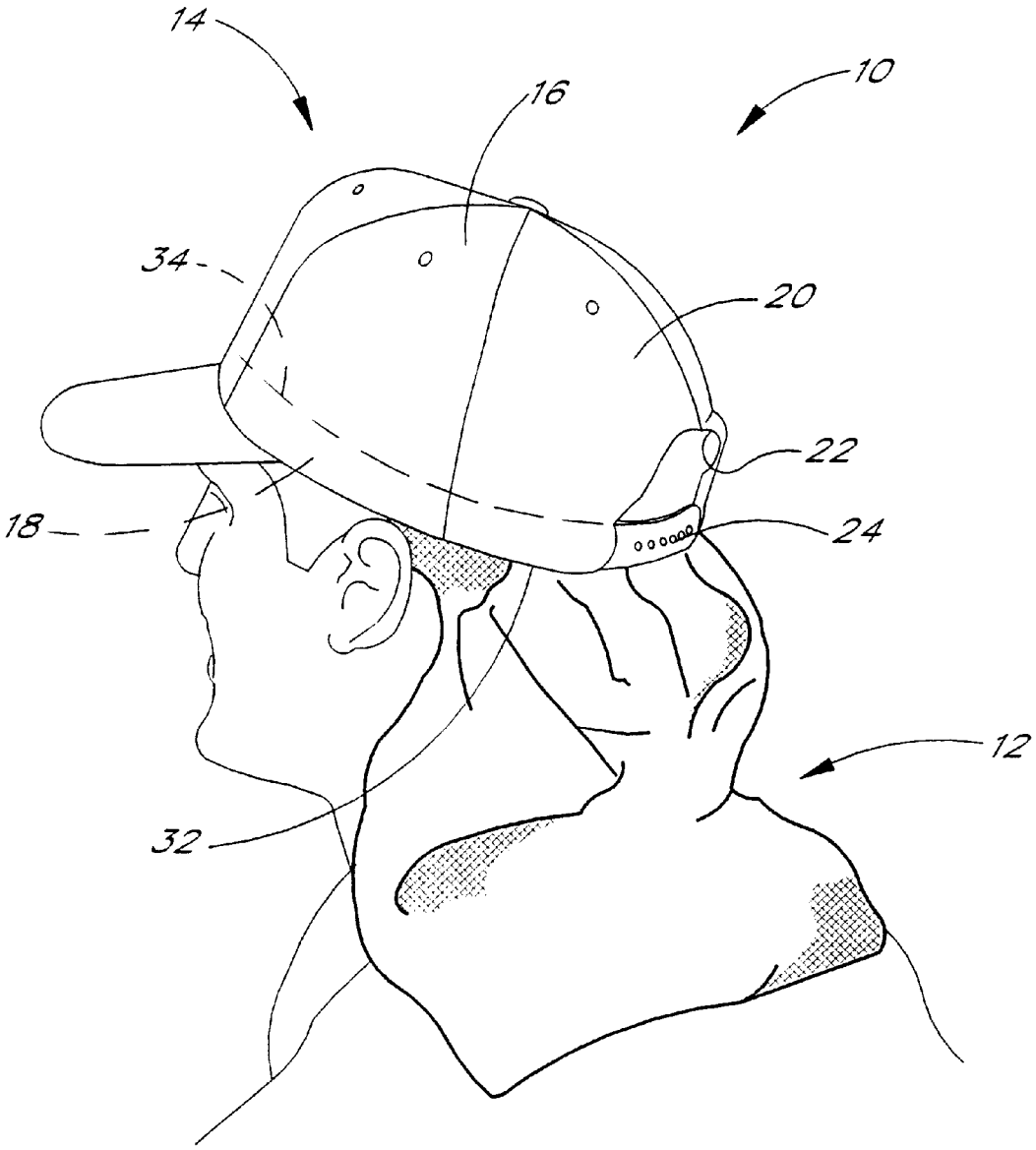
FIG. 1 is a perspective illustration of a hat having a removable weather guard device having features, aspects and advantages in accordance with the present invention.

With initial reference to FIG. 1, a rear perspective view of a cap and a removable weather guard device having features, aspects and advantages in accordance with the present invention, and indicated generally by reference numeral 10, are illustrated therein. The weather guard 12 is illustrated attached to the baseball style cap, indicated generally by reference numeral 14, in order to provide an exemplary environment of use. As will be recognized by those of ordinary skill in the pertinent art, the weather guard 12 may also be employed with a variety of other forms of headwear, including, but not limited to headbands, visors, fitted caps, expandable caps and painters caps. Additionally, a sunshade may also be configured in accordance with the present invention. Accordingly, as used herein, cap shall be construed to mean any type of headwear to which the weather guard may be positively connected as described in detail below. Moreover, weather guard shall be construed to include sunshades.

With continued reference to FIG. 1, the cap 14 is generally comprised of a crown portion 16 and an upturned inner band 18. The crown portion 16 has an exterior surface 20 and an interior surface 22. The band 18 is common to most caps and is well known in the art. As is also well known, the band 18 may include an adjustable portion 24 which allows the diameter of the hat to be expanded or contracted to fit heeds of varying sizes. Moreover, the band 18 may completely circumscribe a lower portion of the crown 16 or may extend only partially around the crown 16. When positioned on the head of a wearer, the band 18 is preferably interposed between the interior surface 22 of the crown portion 16 and the head of a person wearing the cap 14. The band 18 also has an inwardly facing surface 26 and an outwardly facing surface 28 which are disposed such that the outwardly facing surface 28 is nearer the interior surface 22 of the crown 16.

A generally U-shaped pocket 30 may be defined by the outwardly facing surface 28 of the band 18, the interior surface 22 of the crown 16 and any seam or fold which may join the two together proximate a lower edge 32 of the cap 14. However, the band 18 is generally not connected to the interior surface 22 of the crown portion 16 at the band's upper edge 34. Thus, the pocket 30 provides a continuous or semi-continuous receptacle for use in selectively connecting the weather guard 12 to the cap 14 in a manner that will be described below. Additionally, as will be understood from the figures, the pocket 30 has a depth that is generally defined by the height of the band 18. Advantageously, as will be apparent from the description below, the present invention may also be utilized in portions of the headwear having holes in the connection between the headband 18 and the crown portion 16 such that no pocket may be defined in certain locations. Moreover, where it is desired to stitch the upper edge 34 of the band 18 to the crown 14, holes in such stitching may define the positions of the pockets 30.

Figure 2:
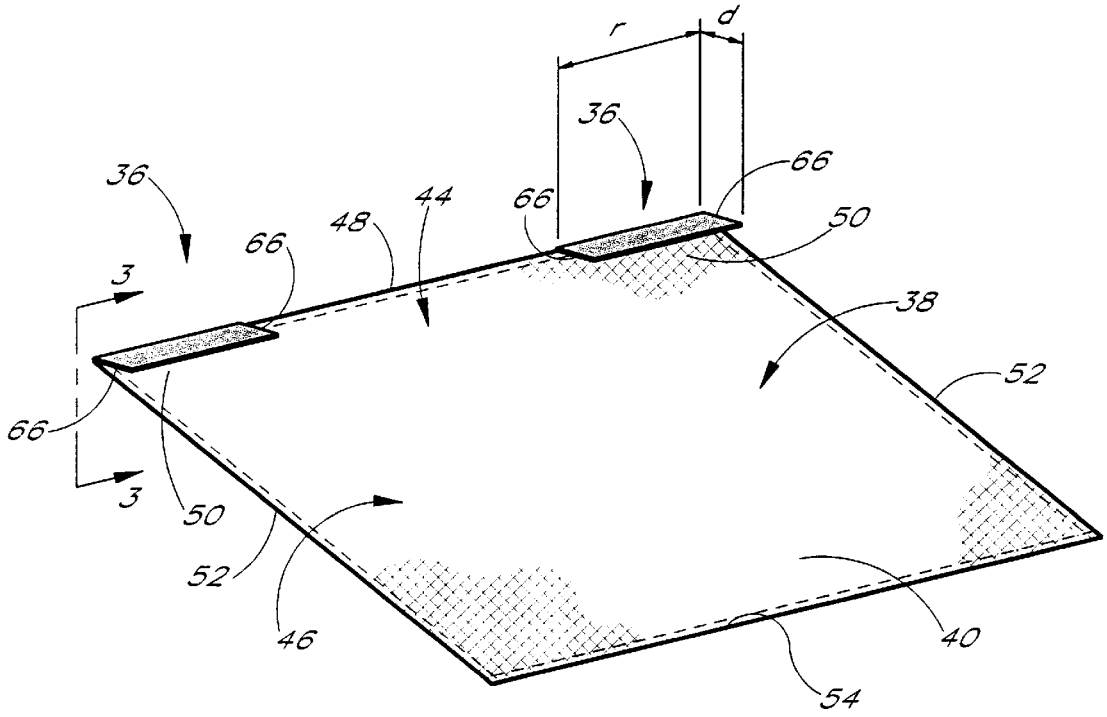
FIG. 2 is a perspective illustration of a removable weather guard device.

With reference again to FIG. 1, the weather guard 12 preferably depends from the cap 14 in a manner to be described in detail below. The weather guard 12 desirably has adequate length to cover the neck or the neck and shoulder region of the wearer for reasons which will be discussed below. With reference now to FIG. 2, the weather guard 12 comprises at least one staying tab 36 and a flexible shield 38. The illustrated embodiment employs a pair of staying tabs 36 arranged in the upper corners of the flexible shield 38; however, one of ordinary skill in the relevant art would readily recognize that the number of staying tabs 36 and their positioning may be varied depending upon the look sought to be achieved and the headwear to which the weather guard 12 will be attached.

The shield 38 may be manufactured from any of a variety of materials. For instance, if the shield is meant to be weatherproof, a liquid-resistant or liquid-proof barrier material may be utilized. Such materials may include, for instance, any of a number of plastic materials, leather, rubber, coated fabric, or a variety of other barrier-type materials. These materials may be opaque, translucent or transparent as desired. If the shield is meant to block the sun, the material may be any of a number of materials capable of shielding the sun. For instance, the material may be selected from UV-reflective or UV-blocking materials, fabric materials such as light cotton, or a variety of other opaque, semi-opaque, or translucent materials which are well known in the relevant art. Because the shield desirably protects the neck or the neck and shoulder regions of the wearer, the shield is preferably long enough and wide enough to cover these regions.

As illustrated in FIG. 2, the shield 38 generally comprises a front side 40, a rear side 42, an upper portion 44 and a lower portion 46. The shield 38 also has an upper edge 48 that may have any geometric configuration; however, the presently preferred upper edge 48 is substantially linear. A substantially linear upper edge 48 generally results in efficient manufacture, reduced waste and, therefore, reduced manufacturing costs.

The upper edge 48 forms a portion of a shield periphery that is defined by all of the edges of the shield and defines the overall shape of the shield 38. Desirably, the periphery forms a rectangle or square; however, other shapes may also be defined by the periphery, such as, for example but without limitation, an inverted arc, a triangle, a torn appearance, a lightning bolt, and other symmetrical or asymmetrical designs. The illustrated rectangular embodiment results in manufacturing efficiencies such as reduced material cutting and, therefore, reduced scrap material.

In the illustrated rectangular embodiment, as well as in most other embodiments, the periphery defines a pair of upper corners 50 at which the upper edge 48 is joined to two substantially downwardly extending side edges 52. Additionally, dependent upon the material utilized for the shield 38, a hemline 54 may be defined around the periphery and may be inset from the periphery a suitable distance.

Figure 3:
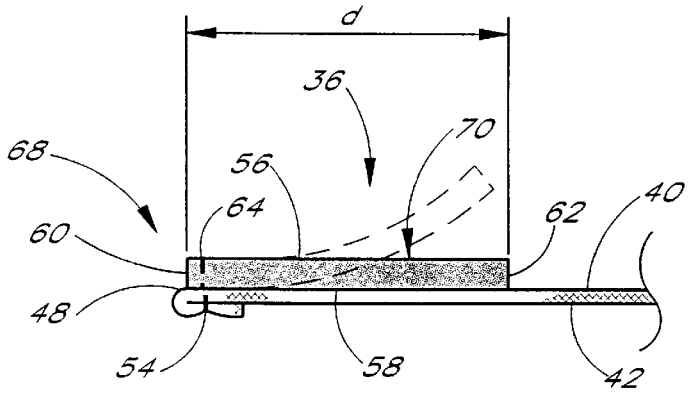
FIG. 3 is a cross-sectional view through a portion of FIG. 2 taken along the line 3—3, with a deflected stay illustrated in dashed line.

As introduced above, the weather guard 12 includes at least one staying tab 36. In the illustrated weather guard 12, two staying tabs 36 are positioned proximate the upper corners 50 of the shield. Each of the staying tabs 36 generally comprise a front side 56, a back side 58, an upper edge 60, a lower edge 62 and an attachment location 64 as illustrated in FIG. 3. The illustrated staying tabs 36 also have a pair of sidle edges 66. An upper portion 68 of each staying tab 36 is generally defined between the upper edge 60 and the attachment location 64 while a lower portion 70 is generally defined between the attachment location 64 and the lower edge 62. As will be appreciated by those of ordinary skill in the pertinent art, the staying tabs, although illustrated as rectangles, may also be configured in a variety of other shapes so long as the shape includes a lower portion which is of sufficient size and shape to perform substantially as described below.

The presently preferred staying tabs 36 generally comprise short strips of a felt material. Other materials may also be suitable for use, including, but not limited to, soft plastics, semi-hard plastics, coated paper stock, card stock, heavier weight fabrics such as heavy canvas and other materials having characteristics that allow sufficient rigidity to maintain the weather guard in place while maintaining adequate pliancy for comfort. The presently preferred felt staying tabs 36 have an average thickness of about 0.065 inch. As will be appreciated, the staying tabs 36 desirably have an average thickness that varies from about 0.0313 inch to about 0.375 inch. Such a range of thickness results in negligible displacement of the crown 16 and the band 18, thereby minimizing any long-term wearing discomfort resulting from such displacement.

More preferably, the thickness will be such that, depending upon the material utilized, the staying tab 36 will conform to the contour of the person's head while maintaining sufficient rigidity to reduce the likelihood of the staying tab 36 working free from the pocket 30. For instance, if the material is too flaccid, the material will snake over the upper edge 34 of the band 18 and allow the staying tab 36 to work free of the pocket 30. Additionally, depending upon the material utilized, the compressive forces may deform the material to flatten the material under compression such that materials having greater thicknesses may be utilized if the deformation will not result in increased long-term discomfort to the wearer.

Figure 4:
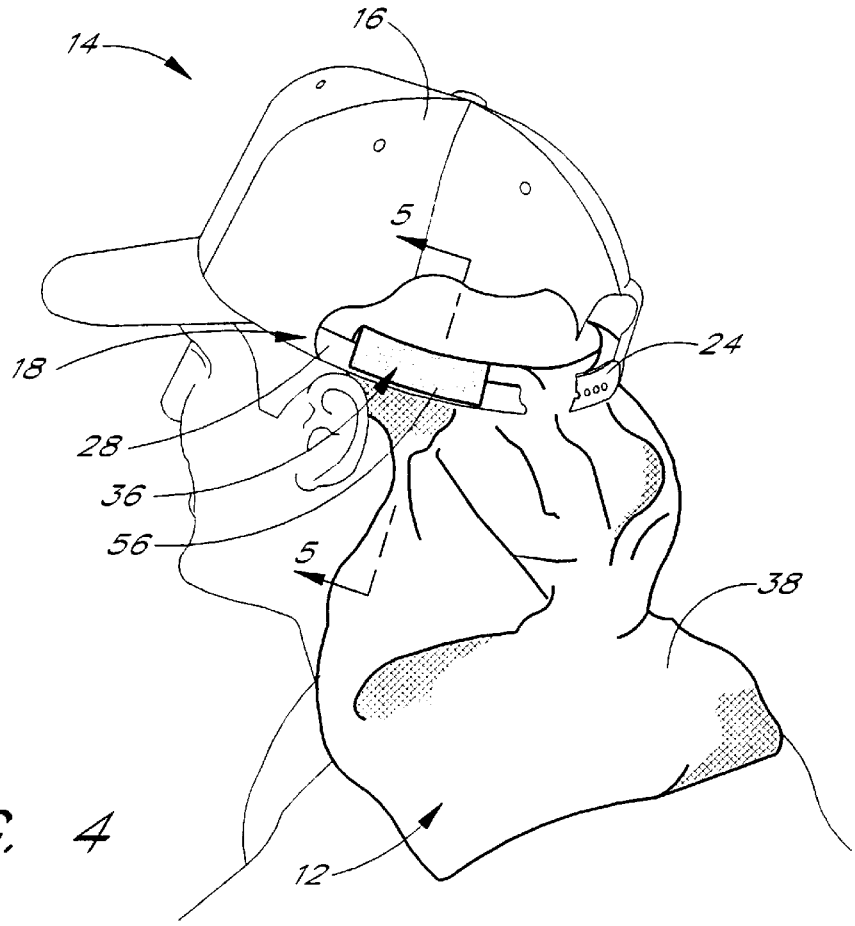
FIG. 4 is a broken-out cross-sectional view of a hat having a removable weather guard device positioned for wearing.

Moreover, the thickness may be varied depending upon the staying tab shape selected. For instance, an elongated rectangle (i.e., where the run length "r" is substantially greater than the depending length "d"), such as that illustrated in FIG. 4, will be more prone to bending about the vertical axis V than about the horizontal axis H due to the characteristics dependent upon the dimensions of the shape. However, a staying tab having a run length substantially less than its depending length is more likely to bend about the horizontal axis H than the vertical axis V. Accordingly, while any shape may work, it is presently preferred to utilize staying tabs 36 having either a square or elongated rectangle peripheral design.

The depending length ("d" in FIG. 3) of the staying tabs 36 may also vary depending upon the application. As used herein, the depending length of the staying tabs 36 is the dimension of the staying tabs corresponding to the width of the band 18. Preferably, the depending length is less than the depth of the pocket 30 or the width of the band 18 in applications where the pocket is interrupted by gaps (i.e., imitation hard helmet baseball caps). More preferably, the depending length is approximately equal to the depth of the pocket 30 or the width of the band 18. Even more preferably, the depending length of the staying tab 36 is slightly larger than the depth of the pocket 30 or the width of the band 18 to accommodate the attachment location 64. In such a configuration, the distance between the attachment location 64 and the lower edge 62 is approximately the same as the depth of the pocket 30 or the width of the band 18. In the presently preferred embodiment, the depending length is approximately 1.188 inches; however, the depending length may vary in preferred embodiments from about 0.5 inch to about 2.25 inches depending upon the application and the positioning of the attachment location 64.

As discussed above, the run length ("r" of FIG. 2) of the staying tabs 36 may also vary depending upon the application. In a presently preferred embodiment, the staying tabs 36 have a run length which is approximately equal to one-quarter of the span of the upper edge 48 of the shield 38. In this embodiment, the weather guard 12 may be folded into quarters without requiring the staying tabs 36 to be folded with the shield. It is understood, however, that the length and positioning of the staying tabs 36 may depend both upon the number of staying tabs 36 utilized and the total span of the upper edge 48 of the shield 38. For instance, if four staying tabs 36 are utilized, each of the staying tabs 36 may extend about one-eighth of the total span of the upper edge 48 and the staying tabs 36 may be positioned such that two staying tabs 36 are aligned with the two outside edges 52 of the shield 38 and the remaining two staying tabs 36 are arranged between the first two staying tabs 36 as desired.

The staying tabs 36 are desirably affixed to the upper portion 44 of the shield 38. Preferably, the staying tabs 36 are arranged near the outside edges 52 of the flexible shield 38. Even more preferably, the staying tabs 36 are arranged such that their outside edges 66 are aligned with the outside edge 52 of the shield 38. Additionally, the staying tabs 36 are most preferably arranged such that their upper edges 60 are aligned with the upper edge 48 of the shield 38. The positioning of the staying tabs 36 in the upper corners 50 of the shield 38 (i.e., aligning the edges 48, 52 and 60, 66) result in enhanced efficiency and greater consistency during manufacture. Additionally, the drape of the shield 38 may be adjusted by altering the placement of the staying tabs 36.

With reference to FIG. 2, the staying tabs 36 may be attached to the shield 38 in any suitable fashion such that a free lower portion 70 extends and is biased downward from the attachment location 64. Specifically, the staying tabs 36 are attached to the shield 38 such that the staying tab 36 is affixed to the upper portion 44 of the shield 38 with the back side 58 of the staying tabs 36 facing the front side 40 of the shield 38. In the illustrated embodiment, the staying tabs 36 are sewn to the flexible shield 38 proximate the upper edges 48, 60 of both. It is contemplated that the staying tabs 36 may also be adhered, cohered, stapled, glued, or otherwise suitably connected to the flexible shield 38. It is contemplated that during manufacture, the staying tabs 36 may be sewn to the shield 38 while the upper edge 48 of the shield 38 is being hemmed, thereby improving the efficiency of manufacture and her reducing manufacturing costs.

Regarding manufacturing of the weather guard 12, one presently preferred process of manufacturing the weather guard 12 will now be described. A swath of fabric, selected from the groups identified above, is initially cut and proportioned as desired for the shield 38. For instance, the fabric may be cut into a rectangle having a run length of about 14 inches and a depending length of about 13 inches. The side edges and the bottom edges of the shield 38 are then hemmed such that the cut edge is folded over onto the back side of the shield 38 and sewn into place. The cut edge at the top of the shield 38 is then folded over to lie along the back side of the shield to form the upper edge 48 of the shield 38. The staying tabs are preferably positioned in the upper corners 50 such that the edges of the staying tabs 36 are aligned with the respective edges of the shield 36. The upper hemline 54 is then sewn, thereby tacking the upper portion 68 of the staying tabs 36 to the shield 38 at the attachment location 64. The weather guard 12 is then ready for use and assembly to the cap as described below.

While one presently preferred from of manufacture has been introduced above, several variations have also been contemplated. For instance, the entire shield may first be hemmed and then the staying tabs may be positioned and attached. Additionally, where hemming of the shield 38 is not required (i.e., leather) the hemming steps may be eliminated. Moreover, where other attachment methods (i.e., gluing, etc.) are being used to affix the staying tabs 36 to the shield 38, the sewing of the staying tabs 36 to the shield 38 may be replaced accordingly. Other variations may also become readily apparent to one having ordinary skill in the relevant fields.

Figure 5:
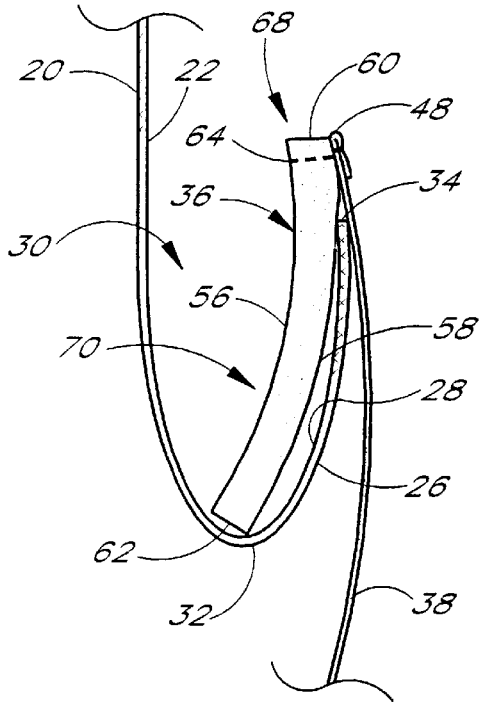
FIG. 5 is a cross-sectional view through a portion of the hat and removable weather guard device of FIG. 4 taken along the line 5—5, in which a deflection of the hat and the stay are exaggerated for illustrative purposes.

With reference now to FIG. 5, assembly of the weather guard 12 to the cap 14 will be described. As illustrated, the free lower portions 70 of the staying tabs 36 of the present weather guard 12 are positioned within the cap's pocket 30 defined between the outwardly facing surface 28 of the band 18 and the interior surface 22 of the crown 16. The illustrated pocket 30 has been exaggerated in FIG. 5 to better illustrate the connection between the weather guard 12 and the cap 14. The seam, or attachment location 64, of the weather guard 12 advantageously hangs on the upper edge 34 of the band with the staying tabs 36 being disposed between the band's outwardly facing surface 28 and the crown's interior surface 22. Being thus positioned, the cap and weather guard assembly 10 is then placed on the head of the wearer.

Due to the compressive forces set up between the outwardly facing surface 28 of the band 18 of the cap 14 and the interior surface 22 of the crown 14, and the head of the wearer and the inwardly facing surface 26 of the band 18 of the cap 14, the weather guard 12 is sandwiched in at least two locations. First, the lower portion 70 of the staying tabs 38 are sandwiched between the outwardly facing surface 28 of the band 18 of the cap 14 and the interior surface 22 of the crown 16. Second, the upper portion 44 of the shield 38 is sandwiched between the head of the wearer and the inwardly facing surface 26 of the band 18 of the cap 14. Thus, the weather guard 12 is securely held in position with the cap 14 positioned on the head of a wearer. Moreover, because the weather guard 12 hangs from the upper edge 34 of the band 18 from the biased staying tabs, the weather guard 12 maintains its positioning even when the cap 14 is removed from the head of a wearer, such as when the wearer wishes to clear sweat from their forehead.

Importantly, a weather guard 12 configured in accordance with aspects of the present invention may provide an attractive appearance for use in advertising or promotional activities. For instance, because the staying tabs 36 are preferably completely concealed within the cap 14 above the cap's lower edge 32, the weather guard 12 has the appearance of being integrally and permanently attached to the cap 14. Moreover, the lower portion 46 of the shield 38 that extends below the lower edge 32 of the cap provides a substantial space that may include advertising, themes or other decorative schemes. For instance, the shield may comprise a patterned material or a silk-screened pattern. Additionally, the shield may have a silk-screened logo such as, for example but without limitation, a NASCAR® racing team logo. A beaded shield portion, a ripped shield portion and a tattered shield portion have also been contemplated. Many other configurations will also be readily apparent to those having ordinary skill in the relevant art.

Other advantages may also be appreciated from the above disclosure. For instance, due to the hanging nature of the weather guard 12, the positioning of the staying tabs 36 may be easily altered when the cap is removed from the head of the wearer by merely sliding the staying tabs 36 along the upper edge 34 of the band 18, or by lifting and repositioning the tabs, to a new position. In this fashion, the drape of the shield 38 may be adjusted between a taut drape and a wrinkled drape, such as that illustrated in FIG. 1. Additionally, the pliant and flexible nature of the weather guard 12 advantageously allows the weather guard 12 to be folded into a size which may be stored in the crown 16 of the cap 14 while the weather guard 12 is not in use. This advantage conveniently enables one to carry the weather guard 12 with them while the weather conditions do not require the weather guard 12 to be deployed.

While a preferred embodiment of the present invention has been illustrated in the figures and described above, variations of the presently preferred embodiment will be apparent to those of skill in the art. Accordingly, the scope of the present invention should not be construed as limited to the specific embodiment shown and described above, but instead should only be limited to the features set forth by the following claims and their equivalents.

What is claimed is:

1. A cap and removable weather guard comprising:

a cap having an exterior shell, the exterior shell having an interior surface, an upturned headband extending at least partially around a lower portion of the shell adjacent to the interior surface, the upturned headband having an outward facing surface and an inward facing surface, the outward facing surface being closer to the shell's interior surface that the inward facing surface, at least one pocket being defined between the outward facing surface of the headband and the interior surface of the shell, wherein the pocket has a depth;

a removable weather guard comprising a flexible shield and at least two staying tabs, the shield having a substantially linear upper edge and a periphery, a hemline inset from the periphery and circumscribing the shield, the staying tabs positioned with an upper edge aligned with the upper edge of the shield and attached to the shield in substantially the same location as the hem, each of the staying tabs further having a downwardly depending tab portion which is biased downward and free to fold about the hem location, the depending tab portion having a length which is substantially the same as the depth of the pocket;

wherein the staying tabs may be positioned within the pocket to attach the removable weather guard to the cap and wherein the weather guard is held in position under compressive forces when the cap is placed on a head of a wearer.

2. The cap and removable weather guard of claim 1, wherein the flexible shield has a substantially rectangular perimeter.

3. The cap and removable weather guard of claim 1, wherein the staying tabs are sewn to the flexible shield.

4. The cap and removable weather guard of claim 3, where in the staying tabs are sewn to the flexible shield by the same stitches forming the inset hemline.

5. The cap and removable weather guard of claim 1, wherein the flexible shield is made from a lightweight cotton fabric.

6. The cap and removable weather guard of claim 1, wherein each staying tab has a running length of approximately one-fourth of the span of the substantially linear upper edge.

7. The cap and removable weather guard of claim 6, wherein the two staying tabs each have an outside edge which is aligned with a side edge of the flexible shield.

8. The cap and removable weather guard of claim 1, wherein the cap is a baseball-style cap.

9. A removable weather guard comprising:

a pair of staying tabs each comprising a top edge, a bottom edge and an attachment location arranged between the top edge and the bottom edge, a free lower portion of each of the pair of staying tabs being defined between the attachment location and the bottom edge, the lower portion of each of the pair of staying tabs forming a downwardly depending element for hooking over an upper edge of a headband of a cap, the pair of staying tabs capable of being concealed within the cap when the downwardly depending elements are hooked over the headband;

a flexible shield comprising a front side, a back side, an upper portion and a lower portion, the flexible shield attached to the pair of staying tabs at the attachment location such that the pair of staying tabs are affixed to the upper portion on the front side of the flexible shield with the lower portion of the flexible shield depending therefrom;, the attachment location allowing the flexible shield and the pair of staying tabs to both be downwardly depending; and the flexible shield further comprising two upper corners wherein the pair of staying tabs further comprise two upper corners at least one of the upper corners of at least one of the pair of staying tabs being aligned with at least one of the upper corners of the flexible shield.

10. The removable weather guard of claim 9, wherein a material for the flexible shield is selected from the group consisting of light weight cotton, leather, rubber, or plastic.

11. The removable weather guard of claim 9, wherein the downwardly depending elements are capable of extending between the headband and an interior wall of a crown of the cap.

12. The removable weather guard of claim 9, wherein the flexible shield having adequate length to cover the neck region of a wearer.

13. The removable weather guard of claim 11, wherein the flexible shield is adapted to have adequate length to cover the shoulder region of a wearer.

14. The removable weather guard of claim 9, wherein the flexible shield is substantially opaque.

15. The removable weather guard of claim 9, wherein the flexible shield further comprises a substantially linear upper edge.

16. The removable weather guard of claim 9, wherein the pair of staying tabs are adhered to the flexible shield.

17. The removable weather guard for selective attachment to a cap of claim 9, wherein the flexible shield is sewn to each of the pair of staying tabs at the attachment location.

18. A cap with a removable weather guard comprising a cap comprising an upturned inner band, an exterior crown surface, and an interior crown surface;

at least two staying tabs, each staying tab comprising a front side, a back side, an upper portion and a lower portion;

a flexible shield, the flexible shield comprising a front side, a back side, an upper portion and a lower portion, wherein the upper portion of the front side of the flexible shield is attached to the back side of the upper portion of each of the staying tabs, the lower portion of the flexible shield depending therefrom;

wherein the at least two staying tabs are engaged with the cap at substantially opposing sides of the cap with the staying tabs being disposed between the upturned band and the interior crown surface and being concealed from the exterior of the cap.

19. The cap with a removable weather guard of claim 17, wherein the cap is a baseball cap.

* * * * *

UNITED STATES PATENT AND TRADEMARK OFFICE

CERTIFICATE OF CORRECTION

PATENT NO. : 6,163,886
DATED : December 26, 2000
INVENTOR(S) : Carter

It is certified that error appears in the above-identified patent and that said Letters Patent is hereby corrected as shown below:

Column 10,
Line 3, please replace “location” with -- respective locations --.

Signed and Sealed this

Eighteenth Day of June, 2002

*Attest:*

*Attesting Officer*

JAMES E. ROGAN
*Director of the United States Patent and Trademark Office*